United States Patent [19]

Block

[11] Patent Number: 4,872,287

[45] Date of Patent: Oct. 10, 1989

[54] LATCHING MECHANISM FOR TROLLEY-HUNG DOORS

[75] Inventor: Gordon S. Block, Roscoe, Ill.

[73] Assignee: C. Hager & Sons Hinge Manufacturing Company, St. Louis, Mo.

[21] Appl. No.: 193,536

[22] Filed: May 13, 1988

[51] Int. Cl.[4] ..... E05D 13/04

[52] U.S. Cl. ..... 49/449; 16/87 R; 49/409

[58] Field of Search ..... 49/449, 409, 410, 411, 49/412; 16/87 R, 93 R

[56] References Cited

U.S. PATENT DOCUMENTS

| | | | |
|---|---|---|---|
| 556,572 | 3/1896 | Bataille . | |
| 1,085,065 | 1/1914 | Speicher . | |
| 1,397,206 | 11/1921 | Geiger | 49/409 X |
| 1,851,296 | 3/1932 | Schwartz et al. . | |
| 1,940,971 | 12/1933 | Schwartz et al. . | |
| 2,990,566 | 7/1961 | Lee | 16/87 R |
| 4,206,850 | 6/1980 | Grube | 16/87 R X |
| 4,502,246 | 3/1985 | Minami | 49/449 X |
| 4,513,554 | 4/1985 | Johnson et al. | 49/449 X |

*Primary Examiner*—Philip C. Kannan

*Attorney, Agent, or Firm*—Gravely, Lieder & Woodruff

[57] ABSTRACT

A track has walls which enclose a hollow interior and among these walls are two laterally directed flanges which are separated by a slot that opens downwardly out of the track for the full length of the track. The track contains trolleys having wheels which roll along flanges of the track and the trolleys carry hangers which depend through the slot in the track and are attached to a door or some other suspended device. One of the trolleys also carries a latching mechanism which engages a keeper located within the track to secure the trolleys and suspended device in a predetermined position along the track. The latching mechanism includes a latch bar which pivots on the trolley between engage and release position and a spring which urges the bar to its engage position—the position in which it will engage the keeper upon encountering the keeper. The latching mechanism also includes a release cord which depends from its latch bar through the slot in the track and, when pulled, causes the latch bar to pivot against the bias of the spring.

26 Claims, 2 Drawing Sheets

28
8
120
16
114
90
58
66
68
48
98
58
32
36
34
108
106
32
114
116
118
86
58
52
56
10
88
72
102
100
48
56
58

60
86
30
60
8
100
58
58
48
48
104
66
50
46
28
72
68
12
78
84

30
86
98
8
28
28
106
48
56
56
48
60
60
46
58
58
32
50
80
82
12
78
84
108

30
90
86
88
72
104
102
100
58
92
52
98
8
96
94
52
54
54
106
116
66
28
16
118
10
34
32
122
124
114
58
50
46
74
74
108
120
36
80
80
12
68
72
78
84

40
38
58
30
58
2
86
46
58
28
34
28
32
36
8
12
78
82
32
84

14
86
102
98
58
106
100
88
58
90
72
60
66
58
108
80
96
76
92
94
46
78
10
58
12
84

LATCHING MECHANISM FOR TROLLEY-HUNG DOORS

BACKGROUND OF THE INVENTION

This invention relates in general to trolley-hung closures and other devices, and more particularly to a latching mechanism for securing the same.

Large doors, such as the type one might expect to find on barns or warehouses or industrial buildings; are commonly suspended from overhead tracks by means of trolleys which roll along those tracks. The typical door of this character thus slides or moves from closed position in which it covers an opening in a wall to an open position where it is located to the side of the opening. The track of course extends along the top of the opening as well as to the side of it, and the trolleys move along the track as the door is shifted from one position to the other. Trolley-hung doors are particularly suited for closing relatively wide openings which cannot be accommodated by a single hinged door, or even multiple hinged doors—opening which are large enough to accommodate wheeled vehicles without disruptive floor tracks or thresholds beneath them. Thus, trolley-hung doors find widespread use on barns, equipment buildings, warehouses, factories, and even for gates along roadways.

While trolley-hung doors possess clear advantages over hinge-mounted doors where large openings exist, they are not nearly as easy to secure as hinged-mounted doors. In this regard, the typical hinge-mounted door is secured with a bolt which projects from the free vertical edge of the door into the strike jamb of the surrounding door frame, that is into the jamb along which the free edge lies when the door is closed. Since trolley-hung doors move along the opening toward and away from the strike jamb, a simple bolt will not secure it to the strike jamb. Latches and keepers have been developed for engaging trolley hung doors with their strike jambs, but this type of latch protrudes from the edge of the door and the keeper may project from the door jamb, so both present hazards along the sides of the door opening—hazards which might prove harmful to people, animals, or vehicles passing through the opening. For example, a keeper along the side of a barn door opening could snag the flesh of a farm animal, such as a cow or horse, passing through the opening. Another popular mechanism for securing trolley-hung doors is the floor or head bolt which operates vertically, engaging a keeper along the bottom or top of the door opening. These devices present alignment problems, for if the bolt does not align precisely with its keeper—which is quite possible given the size of the doors for which they are designed—the door remains unsecured. Furthermore these devices are not easy to install, for they require some type of aperture along the top or bottom of the door opening and installation with enough precision to enable the bolt to align with the aperture.

The latching mechanism of the present invention lies along the track of the trolley-hung door, indeed with the latch being carried by one of the trolleys and the keeper by the track. The two align precisely, because the track confines the trolley and allows little displacement laterally or vertically in contrast to the much larger and heavier door. Moreover, the device is installed without any special preparations to or installations on the door or the door frame.

DETAILED DESCRIPTION

Figure 1:
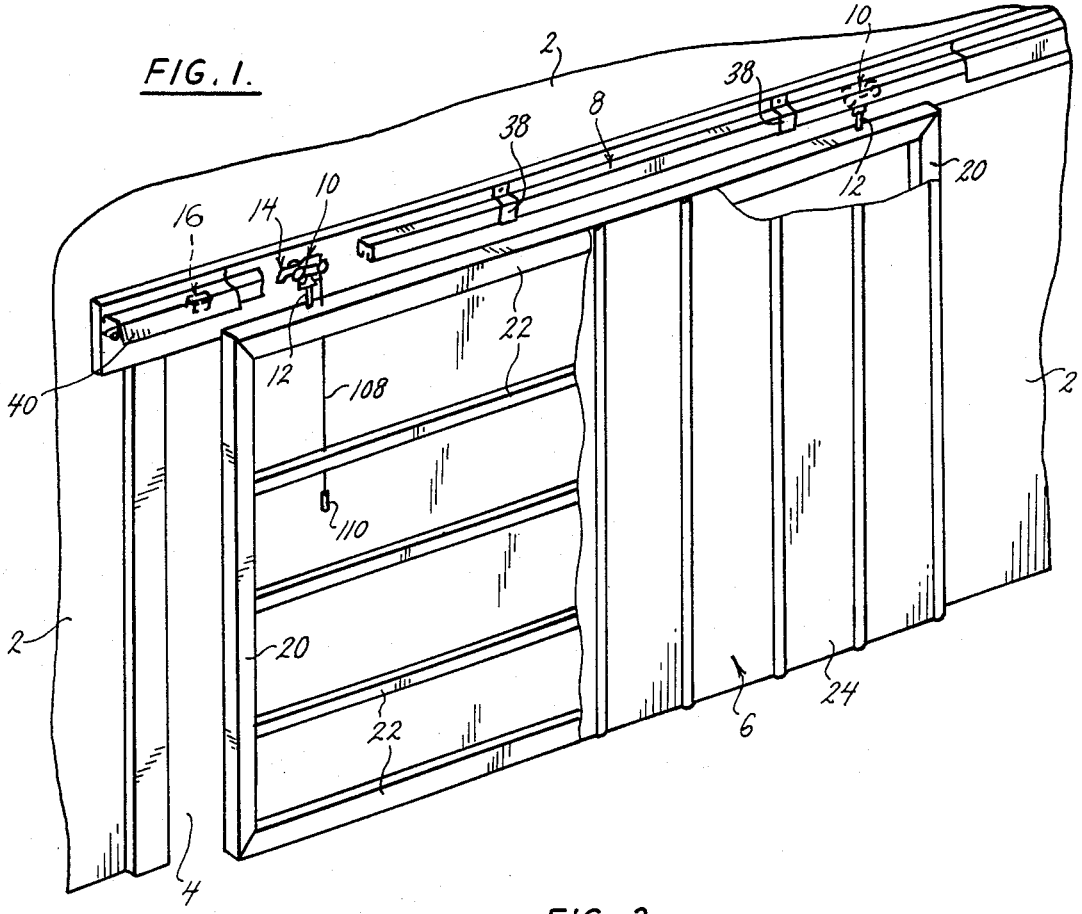
FIG. 1 is a perspective view, partially broken away, showing a door suspended from a track with a trolley having a latching mechanism constructed in accordance with and embodying the present invention.

Referring now to the drawings, a wall 2 (FIG. 1) contains an opening 4 along which a door 6 slides to expose and close the same. The door 6, which is of course large enough to close the opening 4, is suspended from a track 8 which is secured to wall 2, both above the opening 4 and to one side of the opening 4, all without interruption. The track 8, which lies generally horizontally, contains two trolleys 10 which roll freely along it, unless otherwise restrained, and the trolleys 10 are in turn connected through hangers 12 to the top of the door 6, so that the door 6 is carried along with the trolleys 10 as they move along the track 8. This enables the door 6 to move from an open position, in which it lies against the wall to the side of the opening 4, to a closed position, in which it covers the opening 4. One of the trolleys 10 carries a latch mechanism 14 which, when the door 6 is moved to the appropriate position, engages a keeper 16 on the track 8 and secures the door 6 in that position.

The door 2 is long enough to extend from one jamb of the opening 4 to the other, and perhaps slightly beyond such jambs to overlap them. It possesses a typical construction in which vertical members 20 (FIG. 1) are connected by transverse members 22 which are in turn covered by a sheeting or siding 24. The transverse members 22 are at their ends joined firmly to the vertical members 20 and the siding 24 is attached formly to the transverse members 22, thus providing a rigid structure which is the door 2. One of the transverse members 22 extends along the top edge of the door 6 while another extends along the bottom edge, and the trolleys 10 are attached to the former somewhat inwardly from the vertical members 20. In this manner the door 6 is suspended from the track 8.

The track 8 has about twice the length of the door 6 and it extends, without interruption, from about one jamb of the opening 4 past the other jamb and along wall 2 beyond that other jamb. In cross-section, it resembles an inverted channel (FIG. 7), having spaced apart side walls 28, a connecting wall 30 extended between the side walls 28 along the upper margins of those scale walls, flanges 32 turned inwardly from the side walls 28 along their lower margins, and lips 34 turned upwardly for a short distance along the inner margins of the flanges 32. The two lips 34 are spaced apart, creating a slot 36 which opens downwardly out of the interior of the track 8. The upper surfaces of the two flanges 32 lie on either side of the slot 36—between the side walls 28 and the lips 34—where they form ways along which the trolleys 10 roll.

The track 8 is attached to the wall 2 in a generally horizontal orientation with brackets 38 (FIG. 7) which are welded to the track connecting wall 30, and of course the brackets 38 are bolted or otherwise secured to the building wall 2. Both the brackets 38 and the track 8 hung by them may be obscured by a cover 40 which projects outwardly from the wall 2 above the track 8 and then downwardly in front of the outer side wall 28 of the track 8. Indeed, the lower margin of the cover 32 lies slightly below the upper edge of the door 6.

The track 8 and the cover 40 are conventional appliances for trolley-hung doors and are available in the builders hardware market. Indeed, the track 8 is a common roll-formed shape that is also suitable for use as the transverse members 22 of the door 6. The trolleys 10 roll along the inside of the track 8 and are contained wholly within the track 8. Thus, each trolley 10 to be installed on the track 8, must be inserted into one end or the other of the track 8.

Figure 9:
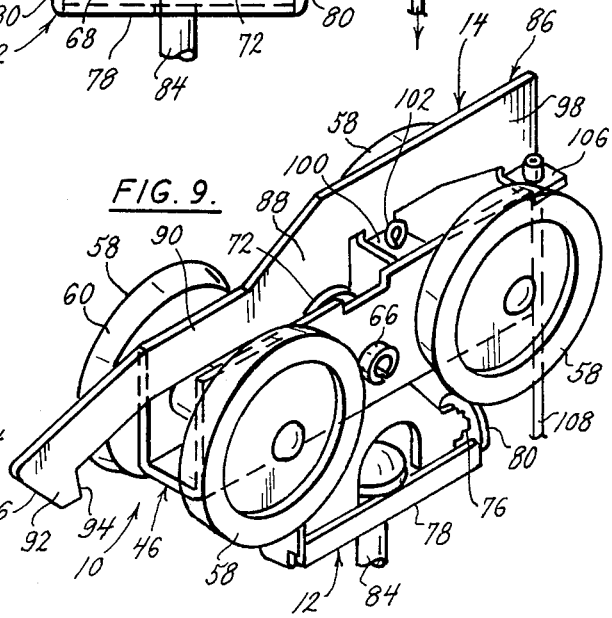
FIG. 9 is a perspective view of a trolley having a latching mechanism constructed in accordance with present invention.

Each trolley 10 includes a channel-shaped body 46 (FIGS. 2 & 9) having spaced apart side walls 48 and a connecting bottom wall 50. The two side walls 48 contain two bearings 52—one at each end of the body 46—with these bearings having their axes perpendicular to the side walls 48 of the body 46. Each bearing 52 contains an axle 54 which rotates in it, and each axle at each of its ends project through a spacer 56 (FIG. 4) and into a wheel 58 to which it is secured by a machine screw or by staking the end of the axle. The bearing 52 may be formed from a traditional bearing material, such as bronze, whereas the spacer 56 should be formed from a low friction material, perhaps a polymer having such characteristics. The spacers 56, of course, separate the wheels 58 from the side walls 48 of the body 46 and thus maintain the body 46 centered between the wheels 58 on each side of it.

Figure 3:
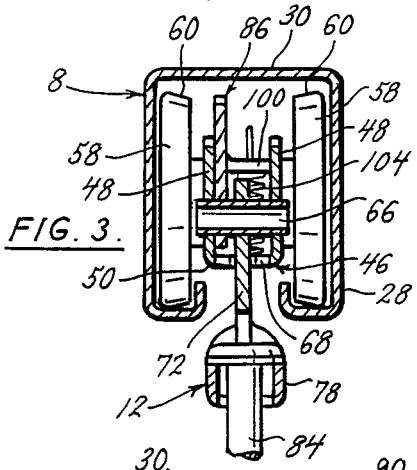
FIG. 3 is a sectional view taken along line 3—3 of FIG. 2.
Figure 4:
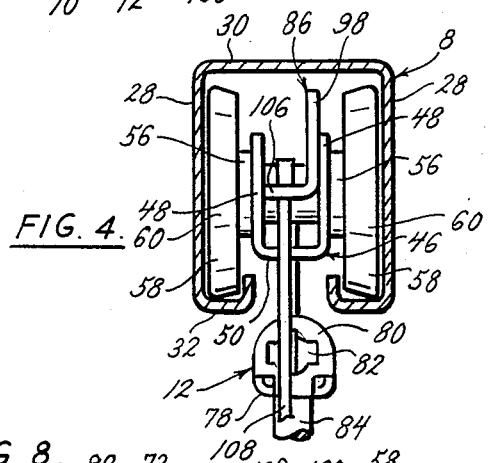
FIG. 4 is a sectional view taken along line 4—4 of FIG. 2.
Figure 7:
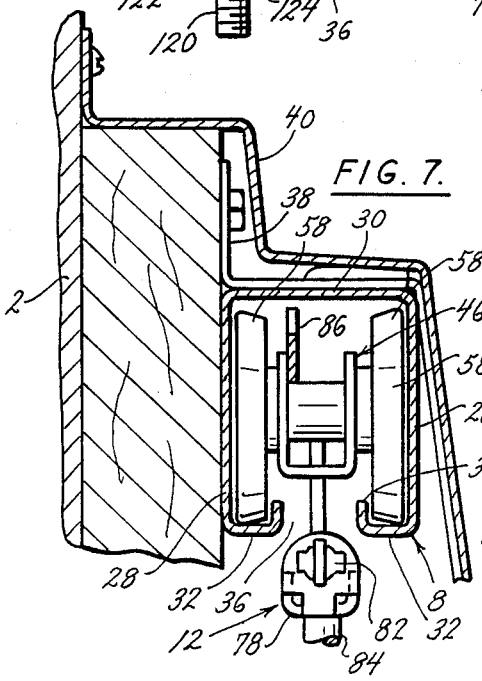
FIG. 7 is a sectional view taken along 7—7 of FIG. 2 and further showing a bracket for securing the track to a wall and a cover for the track.

Each wheel 58 is somewhat cup-shaped in that it has a peripheral rim 60 which is directed axially, but is slightly narrower than the spacing between the side walls 28 and the lips 34 along each side of the track 8. The wheels 58 are of equal diameter, and that is slightly less than the spacing between the connecting wall 30 and the flanges 32 of the track 8. Moreover, the distance between the two wheels 58 of each axle 56 equals the distance between the two flanges 32 of the track 8 so that when the trolley 10 is inserted into the track 8 the rims 60 of its wheels 58 will roll along the ways formed by the upper surfaces of the track flanges 32, while the body 46 will be over the slot 36 (FIGS. 3, 4 & 7).

Figure 5:
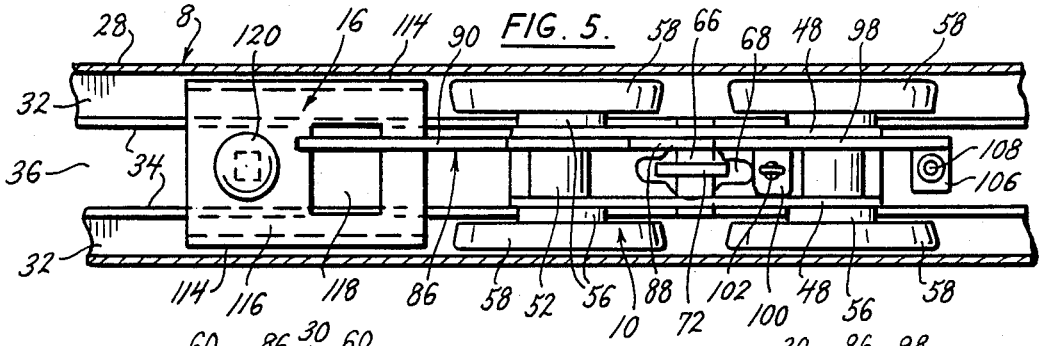
FIG. 5 is a sectional view taken along line 5—5 of FIG. 2.

Midway between the two bearings 52, the channel-shaped body 46 of the trolley 10 is fitted with a cross pin 66 (FIGS. 2 & 3) which lies parallel to the bearings 52 and the axles 56 within them, and this pin is lodged tightly within the holes. To this end, the cross pin 66 may be a conventional roll pin. To enable the cross pin 66 to be driven from the side walls 48, the two bearings 52 are set far enough apart to permit the pin 66 to fit between the two wheels 58 on either side of the body 46. While the pin 66 can be driven from the side walls 48 of the body 46, it normally spans the space between the two side walls 48 where it is located somewhat above the bottom wall 50 of the body 46. Indeed, the bottom wall 50 is provided with an elongated aperture 68 (FIG. 5) directly below the pin 66, and that aperture, being midway between the wheels 58 on each side of the body 46 is located directly above the slot 36 in the track 8, assuming of course that the trolley 10 is within the track 8.

The hanger 12 connects the trolley 10 with the door 6, and it includes a tongue 72 (FIGS. 2 & 3) which projects upwardly through the slot 38 of the track 8 and through the aperture 68 in the bottom wall 50 of the trolley body 46. Indeed, the tongue 72 passes between the two side walls 48 of the trolley body 46 and at its upper end has an aperture through which the cross pin 66 extends, thus coupling the hanger 12 to the trolley 10. The pin 66 fits relatively loosely through the tongue 72 and this enables the tongue 72 to swing backwardly and forwardly with respect to the trolley body 46, as well as laterally, but of course all within the confines of the elongated aperture 68. Below the aperture 68, the tongue 72 flares outwardly and below the track 8 is provided with a pair of pivot arms 74 (FIG. 2) which are directed horizontally in the same general orientation as the slot 36 in the track 8. Each pivot arm 74 has a pair of notches 76, one opening upwardly and the other downwardly.

In addition, to the tongue 72, the hanger 12 has a swivel bracket 78 (FIGS. 2, 4 & 7) which pivots on the tongue 72 about the horizontal axis of its arms 74. The bracket 78 for the most part possesses a channel-shaped configuration to impart strength, but at its ends is provided with tabs 80, each tab of which contains a somewhat elongated aperture 82. Actually, each aperture 82 is for the most part circular with its diameter being only slightly greater than the spacing between the bottoms of the two notches 76 in either arm 74 of the tongue 72, but along each of its sides it has a notch of its own which opens into the circular portion, thus imparting the elongated configuration to the aperture 82. The spacing between the ends of these notches for the aperture 82 exceeds the height of either arm 74 on the tongue 72. By turning the bracket 78 such that the notches of its elongated apertures 82 are oriented vertically, instead of horizontally, one of the tabs 80 of the bracket 78 may be, and indeed is, maneuvered over one of the pivot arms 74 of the tongue 72 with that aperture 82 of course receiving the arm 74. That tab 80 is brought far enough past the set of notches 76 on the arm 74 to enable the tab 80 at the opposite end of the bracket 78 to locate directly beyond the end of the other pivot arm 74. Then, the bracket 78 is moved in the opposite direction and maneuvered such that the tab 80 in its opposite end passes over the other pivot arm 74 for the tongue 72, the elongated aperture of that tab 80 of course receiving the arm 74. When the tabs 80 on the bracket 78 align with the notches 76 in the pivot arms 74 of the tongue 72, the bracket 78 is rotated 90° so that its intervening channel-shaped portion between the two tabs 80 is presented downwardly. The arcuate margins of the apertures 82 in the tabs 80 move into the notches 76 of the pivot arms 74 and prevent the tabs 80 from shifting longitudinally on the arms 74. This, of course, confines the brackets 78 to the tongue 72, while allowing it to pivot on the tongue 72. It is this position to which the pivot bracket 78 gravitates on the tongue 72 when not otherwise restrained.

Finally, the hanger 12 includes a threaded rod or bolt 84 (FIG. 2) which depends from the pivot bracket 78 midway between the tabs 80 on that bracket. Indeed, the bolt 84 passes downwardly through the upper transverse member 22 of the door 6, and threaded over the portion that protrudes below the door member 22 is a nut 85. Thus, the nut 85 holds the door 6 on the bolt 84, and the bolt 84 together with the pivot bracket 78 and tongue 72, all of which constitute the hanger 14, suspend the door 6 from the trolley 10 which rides on the track 8. By turning the nut 85, the height of the door 6 with respect to the opening 4 and track 8 can be adjusted with considerable precision.

The latch mechanism 14 is carried by the trolley 10 such that it aligns with and will engage the keeper 16 which is on the track 8. It includes a latch bar 86 (FIGS. 2, 5 and 9) having an enlarged pivot portion 88 that projects downwardly into the body 46 between the two bearings 52 within the body 46, where it is provided with a hole through which the cross pin 66 of the trolley body 46 extends. This enables the latch bar 86 to pivot on the trolley 10. On its one side the pivot portion 88 merges into a pawl 90 (FIGS. 2 & 9) which projects over the axle bearing 52 at that side of the cross pin 66 and further beyond the end of the trolley body 46 and the two wheels 58 at that end of the body 46. Normally the pawl 88 rests on the bearing 52, but when pivoted about the cross pin 66, it lifts upwardly off of the bearing 52. Beyond the bearing 52, the pawl 90 is inclined somewhat downwardly, and at its end, which is somewhat beyond the rims 60 of the two wheels 58, it is provided with a downwardly directed hook 92, the inside edge 94 of which is inclined downwardly somewhat back toward the trolley 10, at least when the pawl 92 rests on the bearing 52. The hook 92 further has an inclined camming edge 96 which forms the leading surface of pawl 90, the edge 96 being beveled at a greater angle than the inside edge 94 so as to elevate the pawl 90 and thereby pivot the latch bar 90 on the cross pin 66 upon encountering the keeper 16.

Figure 8:
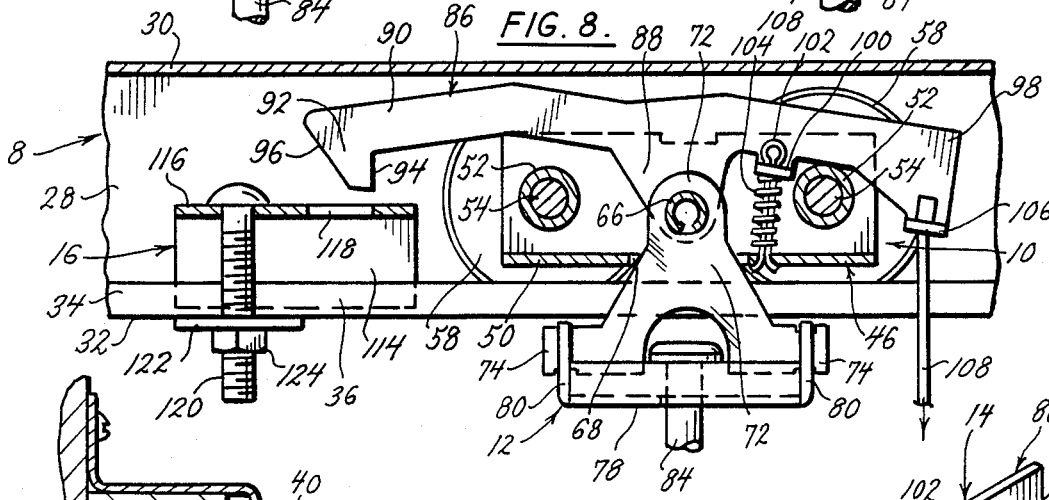
FIG. 8 is a sectional view similar to FIG. 2, but showing the latch bar of the latching mechanism in its release position and thus disengaged from the keeper.

On the opposite side of the pivot pin 66, the pivot portion 88 merges into an actuating arm 98 (FIGS. 2 & 9) which projects over the other bearing 52 and further beyond the end of the body 46 at which that bearing 52 is located. When the pawl 90 rests on the bearing 52 over which it extends, the actuating arm 98 lies somewhat over the bearing 52 over which it extends, but that bearing serves to limit the rotational movement of the latch bar 86, and thus prevents the pawl 90 from being raised high enough to interfere with the overlying connecting wall 30 of the track 8 (FIG. 8). Between the cross pin 66 and that bearing 52 over which the operating arm 98 extends the arm 98 is provided with a laterally directed tab 100 through which a cotter pin 102 (FIG. 2) passes. Indeed, the cotter pin 102 extends downwardly toward and through the bottom wall 50 of the body 46, it being flared outwardly slightly beyond the elongated aperture 68 in that wall. The pin 102 passes through and laterally confines a coil-type compression spring 104 which is interposed between the tab 100 and the bottom wall 50. The spring 104 urges the operating arm 98 upwardly and thus forces the pawl 90 downwardly. Indeed, it normally maintains the latch bar 86 in the position of rotation in which the pawl 90 rests on and is biased against the bearing 52 over which it extends, this being the engage position for the latch bar 86.

Beyond the end of the trolley body 46, the operating arm 98 of the latch bar 86 is provided with another laterally directed tab 106 to which an operating cord 108 (FIGS. 1 & 2), preferably a wire cable, is attached. The cord 108 passes downwardly through the slot 36 in the track 8 and likewise through a hole in the upper transverse member 22 of the door 6, below which it extends along the inside face of the door 6. At its lower end, the cord 108 is provided with a handle 110 or some other type of grip at a convenient height. When the cord 108 is pulled downwardly, it swings the operating arm 98 downwardly against the bias of the spring 94, and thus elevates the pawl 90. In short, a downwardly directed force applied to the cord 108 causes the latch bar 86 to rock backwardly on the pivot pin 66 into a release position.

The keeper 16 lies along and indeed within the track 8 and the hook 92 of the pawl 90 for the latch bar 86 will engage it when that trolley 10 which carries the latch mechanism 14 is moved to the proper position.

Figure 6:
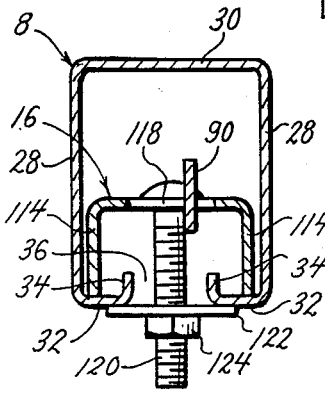
FIG. 6 is a sectional view taken along line 6—6 of FIG. 2 and showing the keeper.

Resembling an inverted channel, the keeper 16 (FIGS. 2 & 6) includes a pair of spaced apart legs 114 and a connecting portion 116 formed integral with and extended between those legs at their upper edges. The spacing between the legs 114 is somewhat less than the spacing between the side walls 28 of the track 8, yet is greater than the spacing between the lips 34 along the inside edges of the flanges 32 on the track. As a consequence, the legs 114 rest on the flanges 32 of the track 8, allowing the connecting portion 116 to extend over the slot 36. Moreover, the legs 114 present the connecting portion 116 at an elevation corresponding to at least some portion of the beveled camming edge 96 on the pawl 90 when the latching bar 86 is in its engage position. Thus, when the trolley 10 is advanced toward the keeper 16, the camming edge 96 of the pawl 90 will come against the end edge of the connecting portion 116 on the keeper 16, causing the pawl 90 to swing upwardly out of its engage position and allowing its hook 92 to move over the upper surface of the connecting portion 116. Within the connecting portion 116 of the keeper 16 is a latch aperture 118 which is close enough to the end edge of the connecting portion 116 to receive the hook 92 of the pawl 90 before the trolley 10 reaches the keeper 16, and of course the aperture 118 is large enough to receive the hook 92. The keeper 16 is secured to the track 8 with a carriage bolt 120 which extends downwardly through the connecting portion 116 and hence through the slot 36 in the track 8, below which it is provided with a large flat washer 122 and a nut 124. When the nut 124 is turned down against the washer 122 and the flanges 32 at the bottom of the track 8, it clamps the keeper 16 firmly to the track 8.

OPERATION

The trolley 10 and hangers 12 suspend the door 6 from the track 8 which is attached to the wall 2 both above and laterally beyond the opening 4. Since the trolleys 10 roll along the track 8, they offer relatively little frictional resistance, notwithstanding the substantial weight of the door 6 suspended from them, and the door 6 is moved between its open and closed positions with the exertion of relatively little force. As the door 6 is moved to its closed position, it approaches one of the jambs of the opening 4, and the keeper 16 is secured to the track 8 near that jamb. The spring 104 of the latch mechanism 14 exerts a biasing force on the latch bar 86, and that force rocks the bar 86 to a position in which its pawl 90 bears against the bearing 52 over which the pawl 90 extends. This is the normal or engage position for the latch bar 86, and in that position the camming edge 96 at the leading end of its pawl 90 aligns with the end edge of the connecting portion 116 or the keeper 16 in the sense that at least a portion of that camming edge 96 is at the same elevation as the end edge of the connecting portion 116.

Figure 2:
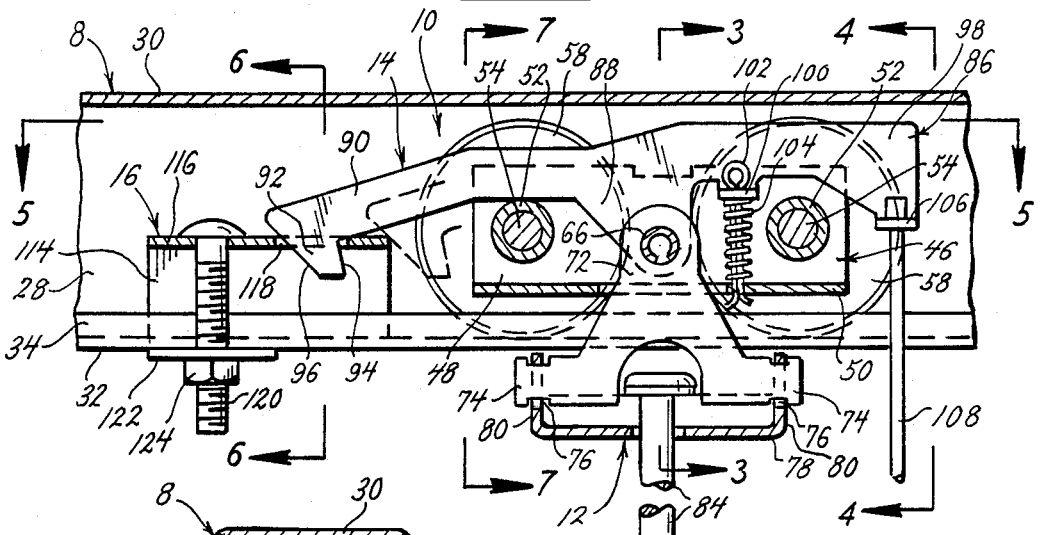
FIG. 2 is a sectional view in elevation of the track, trolley, latch mechanism and keeper forming part of the present invention, with the latch bar of the latching mechanism being in its engaged position and indeed engaged with the keeper.

As the door 6 approaches its fully closed position, the camming edge 96 at the leading end of the pawl 90 for the latch bar 86 comes against the end edge of the connecting portion 116 for the keeper 16, and since the camming edge 96 is beveled backwardly toward the slot 36 in the bottom of the track 8, it rides upwardly over the end edge of the connecting portion 116, thus causing latch bar 86 to rock backwardly against the bias of the spring 104. The hook 92 at the end of the pawl 90 rides up onto the upper surface of the connecting portion 116 and then over that surface until it drops into the aperture 118 under the force exerted by the spring 104 (FIG. 2). Inasmuch as the inside edge 94 of the hook 92 is likewise inclined backwardly, although only slightly, the hook 92 cannot be cammed out of the aperture 118 when the door 6 is urged in the opposite direction toward its open position, even with considerable force. Thus, the latch mechanism 14 and keeper 16 secure the door 6 in its closed position.

Indeed, the hook 92 on the pawl 90 must be withdrawn from the aperture 118 of the keeper 16, before the door 6 can be moved toward its open position. To do so, the handle 110 on the end of the cord 108 is grasped and pulled downwardly. This pulls the operating aim 98 downwardly against the bias of the spring 104 and rocks the latch to bar 86 backwardly (FIG. 8). When the operating arm 98 comes against the bearing 52 over which it extends, the bar 86 is in its release position, a position in which the pawl 90 at the outer end of the bar 86 is elevated enough to withdraw its hook 92 completely from the aperture 118 in the keeper 16. While the force is maintained on the cord 108, the door 6 is moved far enough to enable the hook 92 of the latch bar 86 to clear the keeper 16, whereupon the cord 108 is released, and the door 6 is moved the rest of the way to its open position.

Another latch mechanism 14 may be fitted to the other trolley 10 to engage a keeper 16 at the opposite end of the track 8, and thus hold the door 6 in its open position.

The latch mechanism 14 and keeper 16 are enclosed within the track 8 where they are protected from impacts and tampering. Furthermore, they do not present protuberances along either edge of the door 6 or along either jamb of the opening 4.

This invention is intended to cover all changes and modifications of the example of the invention herein chosen for purposes of the disclosure which do not constitute departures from the spirit and scope of the invention.

What is claimed is:

1. In combination with a track having a hollow interior, horizontal ways presented toward the hollow interior, and a downwardly presented slot between the ways; a trolley which rolls along the ways; and a hanger which is coupled to the trolley and extends through the downwardly presented slot along the ways for suspending a door or other device from the trolley and the track within which the trolley moves; an improved apparatus for holding the trolley in a predetermined position along the track, said apparatus comprising: a latch mechanism carried by the trolley substantially entirely within the hollow interior of the track and being movable on the trolley between first and second positions without projecting out of the track; and a keeper located within the hollow interior of the track and being attached to the track, the keeper being configured and positioned to be engaged by the latch mechanism when the latch mechanism is in its first position and the trolley is in the predetermined position along the track, but not when the latch mechanism is in its second position.

2. The combination according to claim 1 wherein the latch mechanism is spring biased toward its first position and includes means for moving it to its second position.

3. The combination according to claim 2 wherein the latch mechanism includes a camming surface which aligns with the keeper when the latch mechanism is in its first position and is inclined such that the latch mechanism will move toward its second position when the latch mechanism is forced against the keeper under movement of the trolley toward the keeper.

4. The combination according to claim 1 wherein the latch mechanism pivots on the trolley about a horizontal axis that extends through the hollow interior of the track.

5. The combination according to claim 1 wherein the keeper is adjustable along the track and is clamped to the track.

6. The combination according to claim 1 wherein the trolley has a body and wheels that revolve about axes that are generally fixed with respect to the body; and wherein the latch mechanism includes a latch bar which pivots on the body about an axis that is generally fixed with respect to the body and extends through the hollow interior of the track, and as such moves between the first and second positions.

7. The combination according to claim 6 wherein the latch bar has a pawl which engages the keeper when the trolley is the predetermined position and the latch bar is in its first position.

8. The combination according to claim 7 wherein the pawl has a hook at its end, with the hook being configured to engage the keeper, and the pawl has a beveled end surface which aligns with the keeper when the latch bar is in its first position and urges the latch bar toward its second position so that latch bar will engage the keeper.

9. The combination according to claim 8 wherein the latch mechanism includes a spring which is fitted between the trolley body and the latch bar to urge the latch bar to its first position and also a cord attached to the latch bar such that when it is pulled, it causes the latch bar to pivot to its second position in opposition to the force exerted by the spring.

10. A trolley assembly for suspending a door or other device from a track having a hollow interior, said assembly comprising: a body, wheels which rotate about parallel horizontal axes that extend through and are generally fixed with respect to the body; and a latch mechanism having a latch bar which pivots between engage and release positions about an axis that extends through and is generally fixed with respect to the body, the latch bar axis being generally parallel to the wheel axes and at an elevation intermediate the upper and lower surfaces of the wheels, the latch bar including a pawl which is configured to engage a keeper on the track when the latch bar is in its engage position, and a spring located between the body of the trolley and the latch bar to urge the latch bar to its engage position.

11. An assembly according to claim 10 wherein the latch bar axis is located between the wheel axes.

12. An assembly according to claim 11 wherein on at least one of the wheel axes, the wheels are arranged in a pair with a space between the wheels of that pair; and wherein the latch bar extends through the space between the wheels of the pair.

13. In combination with a track having a hollow interior, a downwardly opening slot, and a trolley which rolls within the hollow interior of the track for suspending a door or other device from the track, the trolley having a body and wheels that revolve about axes that are generally fixed with respect to the body, an improved apparatus for holding the trolley in a predetermined position along the track, said apparatus comprising: a keeper attached to the track; and a latching mechanism carried by the trolley within the hollow interior of the track and being movable on the trolley between first and second positions, the latching mechanism being configured to engage the keep when the latching mechanism is in its first position and the trolley is in the predetermined position along the track, but not when the latching mechanism is in its second position, the latching mechanism including a latch bar which pivots on the body about an axis that is generally fixed with respect to the body, and as such moves between the first and second positions, the latch having a pawl which engages the keeper when the trolley is in the predetermined position and the latch bar is in its first position, the pawl having a hook at its end, with the hook being configured o engage the keeper, the pawl further having a beveled end surface which aligns with the keeper when the latch bar is in its first position and urges the latch bar toward its second position so that latch bar will engage the keeper, the latching mechanism also including a spring which is fitted between the trolley body and the latch bar to urge the latch bar to its first position and a cord attached to the latch bar such that when it is pulled, it causes the latch bar to pivot to its second position in opposition to the force exerted by the spring, the cord extending through the downwardly opening slot to be accessible below the track.

14. An assembly for suspending a door or other device from a track, said assembly comprising: a trolley having a body, wheels which rotate about axes that are generally fixed with respect to the body, the wheels of the trolley being arranged in at least two pairs, with a pair on each axis, the body of the trolley being located generally between the wheels of each pair; and a latch mechanism having a latch bar which pivots between engage and release positions about an axis that is generally fixed with respect to the body and includes a pawl which is configured to engage a keeper on the track when the latch bar is in its engage position, and also having a spring located between the body of the trolley and the latch bar to urge the latch bar to its engage position.

15. An assembly according to claim 14 wherein the body of the trolley has spaced apart walls through which pass the axes about which the wheels rotate, and the latch bar of the latch mechanism is located in part between the two walls of the trolley body.

16. An assembly according to claim 15 wherein axis about which the latch bar pivots is located between and is parallel to the wheel axes.

17. An assembly according to claim 16 wherein the latch bar includes a pivot portion through which pivot axis for the bar passes, a pawl which projects in one direction from the pivot portion beyond the axis of rotation for one pair of wheels and an operating arm which projects in the other direction.

18. An assembly according to claim 17 wherein the pawl has a hook at its end.

19. An assembly according to claim 17 wherein the wheels have axles which rotate in bearings that are at least in part located between the two walls of the trolley body, and the pawl of the latch bar rests against the bearing for the wheel axis beyond which it extends when the latch bar is in its engage position.

20. An assembly according to claim 19 wherein the operating arm extends beyond the bearing for the axle of the other pair of wheels, and the spring bears against the operating arm, it being interposed between the axis for the other pair of wheels and the pivot axis for the latch bar.

21. An assembly according to claim 20 and further comprising a cord attached to the operating arm beyond the axis for the other pair of wheels.

22. An assembly according to claim 20 and further comprising a hanger attached to the trolley body at the pivot axis for the latch bar and depending from the trolley with limited pivotal movement about that axis.

23. A support structure comprising: a track having walls which enclose a hollow interior and including laterally directed flanges which are separated by a slot that opens downwardly from the hollow interior of the track; a trolley located within the hollow interior of the track and including a body and wheels that rotate about at least two wheel axes that pass through the body parallel to each other; a latching mechanism carried by the trolley and including a latch bar that pivots on the trolley between engage and release positions, with the pivot axis passing through the trolley body parallel to the wheel axes, and means for urging the latch bar to its engage position; a hanger attached to the trolley body between the two wheel axes and depending therefrom through the slot in the track for attachment to a supported device; a keeper on the track within its hollow interior and being configured to be engaged by the latch bar when the trolley is moved toward the keeper with its latch bar in the engage position.

24. The support structure according to claim 23 wherein means for urging the latch bar to its engage position is spring located between the latch bar and the body of the trolley.

25. The support structure according to claim 23 wherein the body includes a cross pin located at the pivot axis; and wherein the latch bar pivots about the pin and the hanger is suspended from the pin.

26. The structure according to claim 25 wherein at each wheel axis the trolley has two wheels, one on one side of the body and the other on the other side of the body, and the latch bar is located between the two wheels of each pair and includes a pivot portion through which the pivot pin extends, a pawl projected from the pivot portion over one of the wheel axis and provided with a hook beyond the end of the body and a operating arm extended in the other direction from the pivot portion over the other wheel axis.

* * * * *